United States Patent [19]

Sakai

[11] 4,189,224

[45] Feb. 19, 1980

[54] TWO COLOR ELECTROSTATIC COPYING MACHINE

[75] Inventor: Katsuo Sakai, Tokyo, Japan

[73] Assignee: Ricoh Company, Ltd., Tokyo, Japan

[21] Appl. No.: 949,001

[22] Filed: Oct. 5, 1978

[30] Foreign Application Priority Data

Oct. 13, 1977 [JP] Japan ..... 52/122817

[51] Int. Cl.[2] ..... G03G 15/01

[52] U.S. Cl. ..... 355/4; 118/645; 355/10; 355/14 R

[58] Field of Search ..... 355/4, 10, 14, 3 CH, 355/3 TR, 71; 118/645; 96/1.2

[56] References Cited

U.S. PATENT DOCUMENTS

| | | | |
|---|---|---|---|
| 3,960,445 | 6/1976 | Drawe | 355/4 |
| 4,076,404 | 2/1978 | Nagamatsu et al. | 355/4 |

*Primary Examiner*—R. L. Moses

*Attorney, Agent, or Firm*—David G. Alexander

[57] ABSTRACT

A photoconductive drum (22) is formed with first and second photoconductive layers of different spectral sensitivities. First and second chargers (12), (14) apply electrostatic charges of opposite polarities to the drum (22) to form a stratified charge pattern. Radiation of a light image onto the drum (22) causes electrostatic images to be formed in the layers according to color, the net surface potential being negative in areas corresponding to one color such as red, positive in areas corresponding to another color such as black and zero in white background areas. First and second developing units (27), (28) apply positively charged red toner and negatively charged black toner respectively to the drum (22) to form a two color toner image. Where only one charger (12), (14) and only one developing unit (27), (28) is actuated for operation, a positive or negative copy in either color may be produced. The copying machine (21) is operative in either of five copying modes merely by selectively actuating the chargers (12), (14) and developing units (27), (28) in correspondingly different combinations.

17 Claims, 3 Drawing Figures

TWO COLOR ELECTROSTATIC COPYING MACHINE

BACKGROUND OF THE INVENTION

The present invention relates to a two color electrostatic copying machine which is selectively operative for one color positive or negative copying.

A novel and unique two color electrostatic copying machine is disclosed in my copending U.S. Pat. application Ser. No. 912,273, filed June 5, 1978, entitled "COLOR ELECTROSTATOGRAPHIC PROCESS AND MATERIAL FOR PRACTICING SAME". The present invention constitutes improvements to my basic copying machine which enable it to be operated in not only a two color copying mode, but also in a one color positive or negative copying mode in either of the two colors.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copy machine it is essential that the toner images be transferred to the copy sheet in perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink, many offices have purchased or leased full color copying machines for copying such records. The full color copying capability is wasted since it is only necessary to distinguish red from black on the copies.

In addition it is often desired to make copies in only one color. Although full color copying machines can make black and white copies from black and white originals through color addition, the quality is generally not as good as that produced by a conventional black and white copying machine. A full color copying machine is not at all capable of producing black and white copies from colored originals which are required in various applications. It is further disadvantageous to produce black and white copies using a full color copying machine due to the high consumption of expensive colored toner.

SUMMARY OF THE INVENTION

An electrostatic copying machine embodying the present invention includes a photoconductive member having a conductive substrate, a first photoconductive layer formed on the substrate and a second photoconductive layer formed on the first layer, the first and second layers having different spectral sensitivities. First charging means apply a first electrostatic charge of a first polarity to the second layer. Second charging means apply a second electrostatic charge of a second polarity opposite to the first polarity to the second layer in the absence of light. Imaging means radiate a light image of an original document onto the second layer to form an electrostatic image on the photoconductive member through localized photoconduction. First developing means electrostatically charge a first toner of a first color to the second polarity and apply the first toner to the second layer to form a first toner image. Second developing means electrostatically charge a second toner of a second color to the first polarity and apply the second toner to the second layer to form a second toner image. Control means selectively actuate the first and second charging means and the first and second developing means for operation.

The present invention overcomes the drawbacks of the prior art by providing a simple and low cost copying machine which can produce copies in two colors, such as red and black, using only one imaging operation and comprising only one photoconductive drum or belt. In accordance with the present invention, a photoconductive material comprises a conductive substrate, an inner photoconductive layer formed on the substrate and being sensitive to visible light and an outer photoconductive layer formed on the inner layer which is insensitive to red light. An electrostatic charge is applied to the outer layer while radiating the material with light to make only one of the layers conduct. Then, an electrostatic charge of the opposite polarity is applied to the outer layer in the dark. A light image of an original document is radiated onto the outer layer, white areas of the image causing photoconduction of both layers and red areas thereof causing photoconduction of only the inner layer. As a result, white areas of the material have zero surface potential while red and black areas have non-zero surface potentials of opposite respective polarities. Red and black toner particles of opposite electrostatic charge are applied to the material and adhere to the respective charged areas to form a red and black toner image which is transferred to a copy sheet.

In accordance with the improvement of the present invention, positive or negative copies in either red or black may be produced by applying only one electrostatic charge to the drum and applying only red or black toner particles to the drum for development.

It is an object of the present invention to provide an electrostatic copying machine which produces copies in two colors with only one imaging operation using a single photoconductive member.

It is another object of the present invention to provide a two color copying machine which may be easily controlled to produce positive or negative copies in either of the two colors.

It is another object of the present invention to provide a two color electrostatic copying machine comprising a simple and inexpensive apparatus.

It is another object of the present invention to provide a two color electrostatic copying machine which operates at high speed compared to the prior art.

It is another object of the present invention to provide a two color electrostatic copying machine which produces two color copies at greatly reduced cost compared to the prior art.

It is another object of the present invention to provide a generally improved two color electrostatic copying machine.

Other objects, together with the following, are attained in the embodiment described in the following description and shown in the accompanying drawing.

DESCRIPTION OF THE PREFERRED EMBODIMENT

Figure 1A:
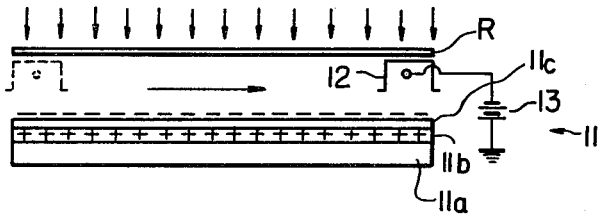
FIGS. 1*a* to 1*f* are diagrams illustrating the operation of a two color electrostatic copying machine embodying the present invention.

Referring now to the drawing, a photoconductive material 11 of the present invention is illustrated in FIG. 1*a*. The material 11 may be in the form of a drum, belt or sheet, although only illustrated in cross section. The material 11 comprises an electrically conductive substrate 11*a* formed of metal or the like and an inner photoconductive layer 11*b* formed on the substrate 11*a*. The layer 11*b* may be similar to that used in conventional electrostatography in that it is rendered photoconductive by visible light.

In accordance with a unique feature of the present invention, an outer photoconductive layer 11*c* is formed on the inner layer 11*b*. The outer layer 11*c* is at least partially optically transparent, and is insensitive to light of a particular color. Where it is desired to make copies in black and red, the outer layer 11*c* is insensitive to red, but rendered photoconductive by light of other colors, especially cyan and white (which contains cyan). Typically, the layer 11*c* is not rendered photoconductive by light having a wavelength greater than approximately 600 millimicrons. The red region begins at approximately 640 millimicrons, and therefore the outer layer 11*c* is insensitive to red light.

Figure 2:
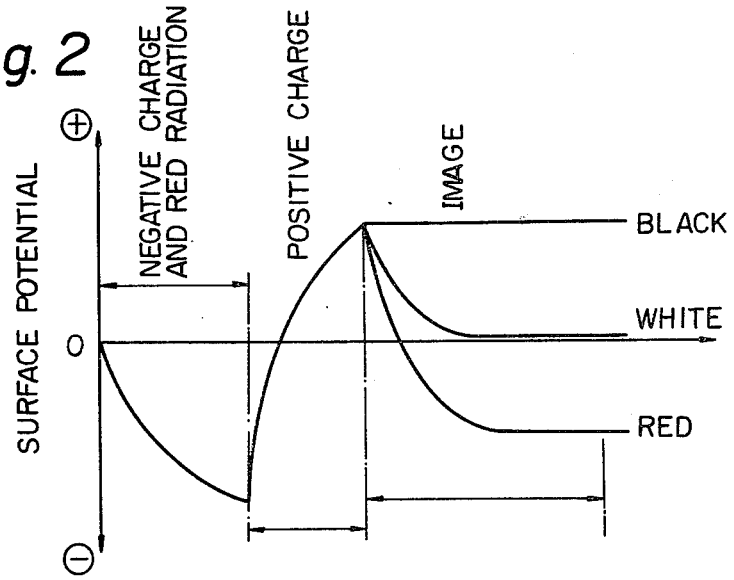
FIG. 2 is a graph further illustrating the operation of the present copying machine.

FIGS. 1*a* and 2 illustrate the first steps of the process, which are performed simultaneously. A corona charging unit 12 applies a uniform negative electrostatic charge to the surface of the outer layer 11*c*, while red light is radiated thereonto. The unit 12 is powered by a negative D. C. source 13. As illustrated, white light is radiated onto the surface of the outer layer 11*c* through a red filter R. The red light causes no photoconduction in the outer layer 11*c*, but passes therethrough to the inner layer 11*b*. The red light causes the inner layer 11*b* to conduct.

The negative charge on the surface of the outer layer 11*c* induces a positive charge on the lower layer thereof. More specifically, positive charges migrate through the substrate 11*a* and lower layer 11*b* which has been rendered photoconductive by the red light upwardly to accumulate at the lower surface of the outer layer 11*c*, or at the interface of the outer layer 11*c* and inner layer 11*b*.

The same effect may be produced by charging the layer 11*c* in the dark and subsequently radiating the same with red light. In this case, during the charging the positive charges will accumulate at the lower surface of the inner layer 11*b*. When the inner layer 11*b* is rendered photoconductive by the red light, the positive charges will migrate through the inner layer 11*b* to the lower surface of the outer layer 11*c*.

In either case, when radiation of the material 11 with red light is terminated, the inner layer 11*b* is no longer rendered photoconductive and the positive charges are trapped at the interface of the layers 11*b* and 11*c*.

Figure 1B:
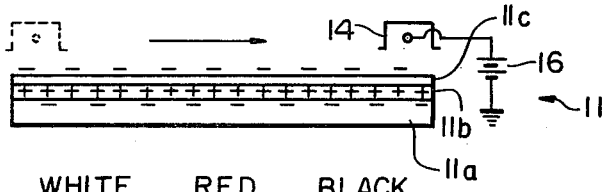

Next, as illustrated in FIG. 1*b*, a corona charging unit 14 applies a positive charge to the outer layer 11*c*. The unit 14 is powered by a positive D. C. source 16. The magnitude of the positive charge applied to the material 11 by the unit 14 is designed to be great enough to reverse the surface potential of the material 11, or charge it from negative to positive. A certain portion of the negative charge on the upper surface of the outer layer 11*c* will be neutralized by the newly applied positive charge, but a certain amount will remain due to attraction of negative charge by the trapped positive charge at the interface of the layers 11*b* and 11*c* and the repulsion thereof for the newly applied positive charge. Thus, although the charge on the upper surface of the outer layer 11*c* remains negative, the net electrostatic potential at the surface of the material 11 is positive due to the effect of the trapped positive charge at the interface of the layers 11*b* and 11*c*.

Figure 1C:
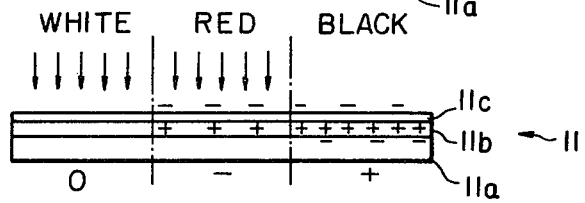

Next, a light image of an original document (not shown) is radiated onto the outer layer 11*c* as shown in FIG. 1*c*. It will be assumed that the light image consists of black, red and white areas as labeled.

Since the black image area is void of visible light of any color, neither of the layers 11*b* and 11*c* is rendered photoconductive in this area. However, the inner layer 11*b* is rendered photoconductive in both the red and white image areas, since white light contains a red component. This causes a portion of the positive charge at the interface of the layers 11*b* and 11*c* to dissipate into the layer 11*b* and substrate 11*a*. Only a positive charge equal to the negative charge at the upper surface of the layer 11*c* will remain at the lower surface of the layer 11*c* in the red area. It will be noted that since the outer layer 11*c* is insensitive to red light, no photoconduction will occur in the layer 11*c* during the step of FIG. 1*c* in the red area of the light image.

The cyan component of the white area of the light image renders the outer layer 11*c* photoconductive. This has the effect of dissipating the charge across the layer 11*c* and eliminating all charge in the white area of the light image.

As the result of these steps, the surface potential in the black area of the light image on the material 11 remains positive, as described above. The potential in the white image area in zero.

In the red image area, a negative charge remains on the upper surface of the upper layer 11*c*. An equal positive charge is induced and trapped at the lower surface of the layer 11*c*. However, the negative charge predominates at the surface of the material 11 in the red image area. Thus, the surface potential on the material 11 is positive in the black image area, negative in the red image area and zero in the white image area.

Figure 1D:
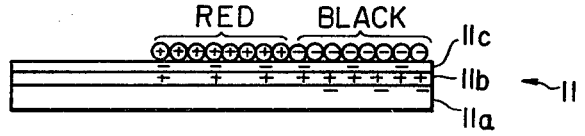

The thusly formed bipolar electrostatic image on the material 11 is developed through application of negatively charged black toner and positively charged red toner thereto, as shown in FIG. 1*d*. The black toner adheres to the positive areas of the electrostatic image and the red toner adheres to the negatively charged areas of the electrostatic image. The red and black toners may be applied either simultaneously in the form of a mixture or sequentially in separate form. Step 1*d* results in the formation of a two color (red and black) toner image.

Figure 1E:
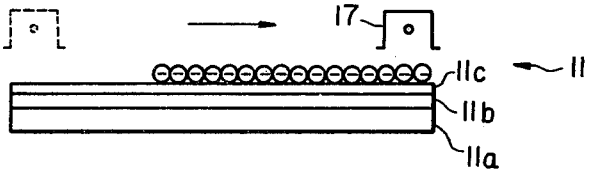

In order to facilitate transfer of the toner image to a copy sheet 19, the red and black toners are all charged to the same polarity by a pre-charger 17. In the illustrated exemplary case, the charge applied by the pre-charger 17 is negative. This step is illustrated in FIG. 1*e*.

Figure 1F:
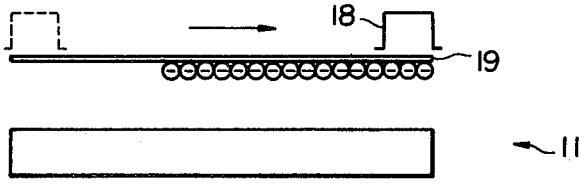

Then, as shown in FIG. 1*f*, a transfer charger 18 applies a positive electrostatic charge to the back of the copy sheet 19. The magnitude of this charge is selected to be high enough to cause the toners to be attracted away from the material 11 and onto the copy sheet 19. As will be described in detail hereinbelow, the toner image is finally thermally fixed to the copy sheet 19 by a pair of fixing rollers 30 to form a two color permanent copy.

Although only one imaging step has been shown and described with reference to FIG. 1*c*, it will be understood that the light image may be radiated onto the material 11 twice; once through a red filter and once through a cyan filter. This improves the contrast of the copy. Radiation through the red filter causes photoconduction in only the layer 11*b*. Radiation through the cyan filter causes photoconduction in only the layer 11*c*. It may further be possible in some applications to eliminate the step of uniform radiation of the material 11 through the red filter R which is illustrated in FIG. 1*a* and still produce a stratified charge pattern.

In accordance with the present invention, other color combinations may be utilized other than red and black, for example red and another chromatic color. Charged toner particles of any colors may be used, as long as they are of the correct polarity, even if they do not correspond to the colors of the original document. The basic principle of the invention is to provide two photoconductive layers, one of which is sensitive to first and second colors and the other of which is sensitive to only the second color. In the present example, the first color is red and the second color is cyan (or the cyan component of white). It is further within the scope of the present invention, where two chromatic colors are to be reproduced, to have one layer sensitive to one of the colors and the other layer sensitive to the other color. An electrostatic image comprising positive and negative areas as well as zero potential areas may be produced utilizing many combinations of stratified charge patterns, colors and filters which are not specifically recited herein but which are within the scope of the present invention.

Figure 3:
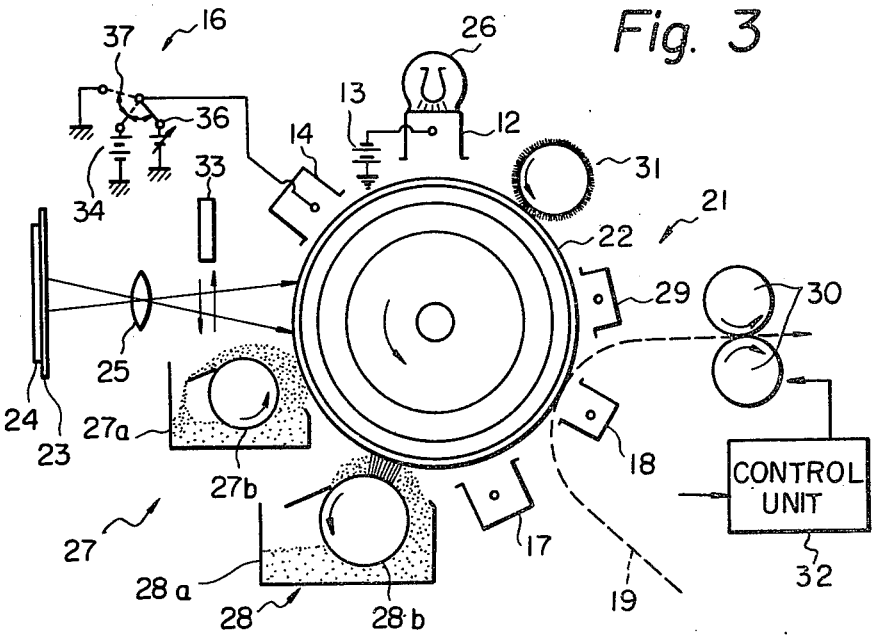
FIG. 3 is a schematic view of a two color electrostatic copying machine embodying the present invention.

An electrostatic copying machine 21 of the present invention is illustrated in FIG. 3 and comprises a photoconductive drum 22 which is rotated counterclockwise at constant speed. Although not shown, the drum 22 is formed with a grounded, electrically conductive core and two photoconductive layers in the manner of the material 11.

A transparent platen 23 supports an original document 24 face down. A red lamp 26 is provided to the charger 12 to apply a negative charge to the drum 22 while illuminating the same with red light. The charger 14 is located downstream of the charger 12 and applies a positive charge thereto in the dark.

An imaging optical system symbolically represented by a converging lens 25 scans the document 24 and radiates a light image thereof onto the drum 22 to form a bipolar electrostatic image. A developing unit 27 applies positively charged, red toner to the drum 22 to develop the red portion of the image. Another developing unit 28 applies negatively charged, black toner to the drum 22 to develop the black portion of the image. The toner image is converted to uniform negative polarity by the pre-charger 17. A feed means (not shown) feeds the copy sheet 19 into engagement with the drum 22 at the same surface speed thereas to transfer the toner image to the copy sheet 19. The transfer charger 18 applies the positive transfer charge to the back of the copy sheet 19 to promote toner image transfer. The toner image is fixed to the copy sheet 19 by heat (and pressure if desired) to produce a finished and permanent copy. A discharger 29 discharges the drum 22 and a cleaning unit 31 removes any residual toner therefrom prior to the next copying operation.

The developing unit 27 comprises a container 27*a* for containing the red toner and an applicator in the form of a magnetic brush 27*b* for applying the red toner to the drum 22. Similarly, the developing unit 28 comprises a container 28*a* for containing the black toner and an applicator 28*b* in the form of a magnetic brush for applying the black toner to the drum 22. Further illustrated in block form is a control unit 32 connected to control the various other components of the copying machine 21.

The copying machine 21 is controlled by the control unit 32 to produce two color copies in the manner described hereinabove. More specifically, all of the charging units 12 and 14 and developing units 27 and 28 are actuated for operation. The manner in which the copying machine 21 is controlled to produce one color positive and negative copies will not be described.

Positive Black Copying (first method)

Black and white copies may be produced from black and white or colored documents by means of a contrast filter unit 33 which comprises a plurality of contrast filters or different colors. Placing a cyan or other suitable color contrast filter in the path of the light image prevents photoconduction of the layer 11*b* and thereby prevents the formation of negative electrostatic image areas. More specifically, photoconduction can only occur in the layer 11*c*, thereby dissipating the charge at the interface of the layers 11*b* and 11*c*. The positive charges trapped at the lower surface of the layer 11*b* predominate, thereby producing a positive electrostatic surface potential. Since there are no areas of negative electrostatic image potential, no red toner will adhere to the drum 22 and the produced copies will be only in black and white.

Positive Red Copying (first method)

Placing a red filter in the path of the light image will produce copies only in red and white. The red filter prevents photoconduction of the layer 11c and the formation of positive electrostatic image areas. Photoconduction of the layer 11b causes dissipation of the positive charges at the lower surface thereof until they balance the negative charges at the upper surface of the layer 11c. The negative charges predominate, producing a net negative surface potential. Black toner will not adhere to the drum 22 and the produced copies will be only in red and white.

Positive Black Copying (second method)

In this method only the charging unit 14 is actuated to form a positive electrostatic charge on the drum 22 in the dark. The charging unit 12 and lamp 26 are disabled. In addition, only the developing unit 28 is actuated to apply negatively charged black toner to the drum 22. The developing unit 27 is disabled such as by removing all red toner from the magnetic brush 27b with a doctor blade (not shown). White image areas cause photoconduction in both layers 11b and 11c and reduce the surface potential of the drum 22 to approximately zero. In black image areas there is no photoconduction and the positive charge of the charging unit 14 is not dissipated. In red image areas only the layer 11b conducts allowing negative charges to migrate through the layer 11b to the upper surface thereof to balance the positive charge on the upper surface of the layer 11c. This reduces the net positive surface potential on the drum 22. Black toner adheres to the positive electrostatic image areas to produce a black and white copy. Preferably, the filter means 33 moves a cyan filter into the path of the light image to absorb red light and prevent photoconduction in the red image areas. In this manner, the red image areas will appear black in the copy at a density equivalent to the black image areas. The pre-charger 17 is not required.

Positive Red Copying (second method)

This method corresponds to the above method of positive black copying except that the charging unit 12 is actuated rather than the charging unit 14 and the developing unit 27 is actuated instead of the developing unit 28. The lamp 26 is not energized. The charging unit 12 applies a negative potential to the drum 22 to produce a negative electrostatic image which attracts positively charged red toner from the developing unit 27. A cyan filter is also preferable in this case. The principle of operation is the same as for the positive black copying process except that the polarity of the charge is reversed.

Negative Black Copying

A black and white negative (reversed) copy can be produced by actuating the charging unit 12 and the developing unit 28. In this case, the charging unit 12 applies a negative charge to the drum 22 to form a negative electrostatic image which repels the negatively charged black toner. However, a negative bias voltage is applied by the control unit 32 to the developing unit 28 which repels the negative black toner against the drum 22. The black toner does not adhere to the negative image areas but adheres to the uncharged white background areas. A small amount of toner will adhere to the red image areas if a cyan filter is not used. The pre-charger 17 is not required.

Negative Red Copying

In this case, the charging unit 14 and developing unit 27 are actuated. The charging unit 14 applies a positive charge to the drum 22 to form a positive electrostatic image which repels the red toner. The red toner adheres to the uncharged white image areas to produce a negative red and white copy.

As mentioned hereinabove, the control unit 32 applies a bias voltage to the developing units 27 and 28. For positive image copying, the bias voltage has a polarity opposite to the toner and is approximately equal to the potential of the white electrostatic image areas. However, for negative image copying, the bias voltage must be reversed and increased to effectively repel the toner onto the white electrostatic image areas against the potential of the electrostatic image. The bias voltage may also varied for two and one color copying.

The positive D. C. source 16 comprises a fixed source 34, a variable source 36 and a switch 37 for selectively connecting the charging unit 14 to the sources 34 and 36 or ground. When the charging unit 14 is not being used during negative black copying or positive red copying, it is connected to ground through the switch 37. For two color copying, the charging unit 14 is connected to the variable source 36 through the switch 37. The variable source 36 allows adjustment of the positive electrostatic charge magnitude in accordance with the density of red areas on the document 24. The positive electrostatic charge magnitude should be decreased as the red area density increases.

The fixed source 34 is connected to the charging unit 14 for single color copying (positive black copying and negative red copying), and produces an electrostatic charge magnitude which is higher than the highest value obtainable with the variable source 36.

Due to practical design constraints, the red and black toners have different heat capacities. Generally, the fixing rollers 30 must apply a higher temperature to the copy sheet 19 to fuse the red toner thereto than to fuse the black toner thereto. Thus, whenever the toner image comprises red toner, the higher temperature must be used. In accordance with the present invention, the control unit 32 controls the fixing rollers 30 to be heated to a predetermined low temperature for black and white copying and to a predetermined higher temperature for two color copying and red and white copying. This allows a saving of electrical power during black and white copying.

The following experiments illustrate the advantageous operation of the present invention.

Experiment 1

A laboratory apparatus was constructed which corresponded to the copying machine 21 shown in FIG. 3. The substrate of the drum 22 was made of aluminum. The inner layer comprised a 1 micron thick layer of selenium mixed with 10% tellurium by weight and a 50 micron thick layer of pure selenium. The outer layer was 10 microns thick and formed of bromopyrene.

The surface speed of the drum 22 was 134 mm/sec. The voltage of the charging unit 12 was −6.5KV. The voltage of the charging unit 14 was +4.5KV to +5.0KV for two color copying and +5.5KV for one color copying. The developing unit 27 was operated only for two color copying at a bias voltage of −100V.

A doctor blade removed all red toner from the magnetic brush 27b to render the developing unit 27 inoperative for one color copying.

The developing unit 28 was operated for both two color and one color copying at bias voltages of +100V and +200V respectively.

The voltages of the pre-charger 17 and transfer charger 18 were −5.0KV and +5.0KV respectively. The temperature of the fixing rollers 30 was 200° C. for two color copying and 170° C. for one color black copying. A filter in the filter means 33 having a transmission wavelength range of 500 to 650 nM was used.

The laboratory apparatus was operated continuously to produce 10,000 copies. Out of each 10 copies, 9 were black and white and one was two-color. All copies were of very high quality.

Experiment 2

The developing unit 27 was removed from the apparatus of experiment 1 and the container 28a of the developing unit 28 filled with a 1:1 dry mixture of red and black toners. The red and black toners were selected such that friction therebetween induced a positive electrostatic charge on the red toner and a negative electrostatic charge on the black toner. The developing unit 28 was operated at a bias voltage of zero.

Copies were produced in the same manner as in experiment 1. Up until about the 50th copy the quality was excellent for both two color and black and white copying. However, thereafter the red colors became excessively dark due to mixing of the black toner with the red toner. However, the experiment proved that the basic principle of the invention is workable.

Experiment 3

The procedure of experiment 2 was repeated with the developing unit 27 removed and the developing unit 28 replaced with a known developing unit for the semi-moist developing process. The developing mixture used comprised 1:1 mixture of positively charged magenta toner and negatively charged black toner in a liquid dispersant. All copies produced were of high quality. In addition, the electrostatic transfer efficiency of the toner images did not vary significantly regardless of whether the pre-charger 17 was actuated or not.

In summary, it will be seen that the present invention provides an improved copying machine which is capable of producing two color copies or one color positive or negative copies using a simple and inexpensive apparatus. Various modifications will become possible for those skilled in the art after receiving the teachings the present invention without departing from the scope thereof.

What is claimed is:

1. An electrostatic copying machine including a photoconductive member having a conductive substrate, a first photoconductive layer formed on the substrate and a second photoconductive layer formed on the first layer, the first and second layers having different spectral sensitivities, characterized by comprising:

first charging means for applying a first electrostatic charge of a first polarity to the second layer;

second charging means for applying a second electrostatic charge of a second polarity opposite to the first polarity to the second layer in the absence of light;

imaging means for radiating a light image of an original document onto the second layer to form an electrostatic image on the photoconductive member through localized photoconduction;

first developing means for electrostatically charging a first toner of a first color to the second polarity and applying the first toner to the second layer to form a first toner image;

second developing means for electrostatically charging a second toner of a second color to the first polarity and applying the second toner to the second layer to form a second toner image; and control means for selectively actuating the first and second charging means and the first and second developing means for operation.

2. A copying machine as in claim 1, further comprising light source means for uniformly radiating the second layer with light of a color selected to render only one of the first and second layers photoconductive while the first charging means applies the first electrostatic charge to the second photoconductive layer.

3. A copying machine as in claim 1, in which the first and second developing means are integral and comprise a container for containing the first and second toners and applicator means for applying the first and second toners to the second layer, the first and second toners being mixed together in the container and applied by the applicator means to the second layer in mixed form.

4. A copying machine as in claim 3, in which the container further contains a liquid dispersant for dispersing the first and second toners.

5. A copying machine as in claim 1, in which the control means is operative to actuate all of the first and second charging means and first and second developing means for two color copying.

6. A copying machine as in claim 1, in which the control means is operative to actuate only the first charging means and the first developing means for one color positive copying in the first color.

7. A copying machine as in claim 1, in which the control means is operative to actuate only the first charging means and the second developing means for one color negative copying in the second color.

8. A copying machine as in claim 1, in which the control means is operative to actuate only the second charging means and the second developing means for one color positive copying in the second color.

9. A copying machine as in claim 1, in which the control means is operative to actuate only the second charging means and the first developing means for one color negative copying in the first color.

10. A copying machine as in claim 1, in which the control means is operative to selectively control the copying machine for two color copying by actuating all of the first and second charging means and the first and second developing means or for one color copying by actuating only one of the first and second charging means and only one of the first and second developing means.

11. A copying machine as in claim 10, in which the control means is operative to control the first charging means to apply the first electrostatic charge at zero magnitude for one color positive copying in the second color, at a first non-zero magnitude for two color copying and at a second non-zero magnitude for one color positive copying in the first color.

12. A copying machine as in claim 11, in which the second non-zero magnitude is higher than the first non-zero magnitude.

13. A copying machine as in claim 1, in which the control means is operative to control the first charging means to adjust a magnitude of the first electrostatic charge in accordance with a density of the first color on the original document.

14. A copying machine as in claim 1, in which the imaging means comprises selectively actuatable contrast filter means.

15. A copying machine as in claim 1, further comprising transfer means for transferring the toner images to a copy sheet, the transfer means including transfer charging means for electrostatically charging the copy sheet to the first polarity, the copying machine further comprising pre-charging means for electrostatically charging the toner images to the second polarity prior to toner image transfer.

16. A copying machine as in claim 1, further comprising transfer means for transferring the toner images to a copy sheet and thermal fixing means for fixing the toner images to the copy sheet, the control means being operative to control the fixing means to apply a first temperature to the copy sheet when the first developing means is actuated and a second temperature to the copy sheet when the first developing means is unactuated.

17. A copying machine as in claim 10, in which the control means is further operative to apply a first bias voltage to the first developing means for two color copying, a second bias voltage to the first developing means for one color positive copying in the first color and a third bias voltage to the first developing means for one color negative copying in the first color.

* * * * *